US005079937A

United States Patent [19]

Schöler

[11] Patent Number: 5,079,937

[45] Date of Patent: Jan. 14, 1992

[54] CONTROLLABLE CONVEYOR ARRANGEMENT FOR COOLING ROLLED WIRE

[75] Inventor: Rolf Schöler, Hilchenbach, Fed. Rep. of Germany

[73] Assignee: SMS Schloemann-Siemag Aktiengesellschaft

[21] Appl. No.: 624,978

[22] Filed: Dec. 10, 1990

[30] Foreign Application Priority Data

Dec. 9, 1989 [DE] Fed. Rep. of Germany ..... 3940735

[51] Int. Cl.[5] ..... B21B 39/04; B65G 21/10; G01B 9/08; B21F 23/00

[52] U.S. Cl. ..... 72/24; 72/37; 72/201; 72/251; 72/426; 198/345.2; 198/587; 266/106; 356/391; 140/2

[58] Field of Search ..... 72/21, 24, 27, 31, 37, 72/133, 201, 251, 420, 426, 446; 198/339.1, 345.2, 460, 577, 587, 589, 605; 266/106; 356/391, 399; 358/101; 140/2

[56] References Cited

U.S. PATENT DOCUMENTS

| | | | |
|---|---|---|---|
| 3,865,153 | 2/1975 | Vitelli | 140/2 |
| 4,220,026 | 9/1980 | Tanaka et al. | 140/2 |
| 4,320,646 | 3/1982 | Bindernagel et al. | 72/201 |
| 4,644,773 | 2/1987 | Duri | 72/201 |
| 4,651,203 | 3/1987 | Peterson | 356/399 |
| 4,653,630 | 3/1987 | Bravin | 198/577 |

FOREIGN PATENT DOCUMENTS

| | | | |
|---|---|---|---|
| 2262760 | 7/1973 | Fed. Rep. of Germany | 72/37 |
| 2536236 | 2/1977 | Fed. Rep. of Germany . | |

*Primary Examiner*—Lowell A. Larson
*Assistant Examiner*—Thomas C. Schoeffler
*Attorney, Agent, or Firm*—Toren, McGeady & Associates

[57] ABSTRACT

An arrangement for cooling in a controlled manner a rolled wire from rolling temperatures. The arrangement includes a cooling unit arranged following a finishing stand, a coiling unit for the wire and a cooling and conveying system for the spread-out wire coils. A pivotable and/or displaceable coil placement unit is arranged between the coiling unit and the cooling and conveying system.

7 Claims, 2 Drawing Sheets

CONTROLLABLE CONVEYOR ARRANGEMENT FOR COOLING ROLLED WIRE

BACKGROUND OF THE INVENTION

1. Field of the Invention

The present invention relates to an arrangement for cooling in a controlled manner a rolled wire from rolling temperatures. The arrangement particularly includes a cooling unit, for example, water ramps, arranged following the finishing stand, a coiling unit for the wire and a cooling and conveying system for the spread-out wire coils.

2. Description of the Related Art

Wire is rolled in a rolling mill train in which the initial material, for example, a rod-shaped semi-finished steel having a cross-sectional area of 100 mm to 150 mm, is conveyed from a holding furnace to the rolling mill stands of a blooming train. The material rolled in the blooming train is subsequently rolled into round material in an intermediate train and a finishing train. The round material is then deformed thermomechanically in a multiple-stand roll series into an endless rolled material having a diameter of approximately 5.5 mm. The finished wire arriving from the finishing roll series is supplied directly from the rolling heat to the Stelmor cooling line which is used predominantly. In the Stelmor cooling line, the wire is cooled in a controlled manner in order to obtain certain material properties, i.e., a uniform physical quality of an entire length of the rolled wire and, thus, a good drawing property. Following the finishing stand series, the wire initially travels through water cooling stretch and is then stretched out on a conveyor system by means of a coiling unit. The wire is further cooled in a predetermined manner during the transport to the coil collector by means of blower air. The conveyor system either is a chain conveyor or a roller conveyor under which the cooling blowers are arranged in sections which are spatially separate from each other. The cooling air is blown from underneath through slots in the conveyor system. In the case of high-carbon steels, the temperature of the entering coils is 800° to 850° C., and in the case of low-carbon steels, the maximum temperature is 900° C. In the case of low-carbon steels, the coils are conveyed as slowly as possible and without cooling air. In the case of high-carbon steels, the coils are conveyed with a high conveying speed and with maximum cooling air supply.

German patent 25 36 236 discloses a cooling and conveying arrangement for wire which is spread out by a coiling unit, wherein the conveying arrangement includes individual transporting sections with adjustable transporting speeds. The length of the successive transporting sections of the conveying arrangements are dimensioned for the desired temperature drop within each section occurring with the greatest possible wire dimensions. The temperature of the wire loops is determined by means of a radiation pyrometer at the end of each conveying section.

In previously known cooling and conveying arrangements for finished wire to be spread out by means of a coiling unit, cooling of the wire is regulated in a relatively complicated manner in order to obtain, as mentioned above, certain material properties of the wire, particularly with respect to the quality of the wire surface. One of the prerequisites for this is that the coiling unit must operate synchronously with the finishing stand series of the rolling mill train, so that no pulling or pushing forces occur and the wire can be placed in uniform spread-out coils on the subsequent conveyor system by means of the placement head. For this reason, the downwardly inclined coiling unit is of robust construction and has a particularly stiff housing in order to avoid natural vibrations. The placement tube is also of stable construction and is shaped and assembled in such a way that it can be easily blown out and a quiet wire guidance is ensured.

However, it has been found in some cases that certain tolerances in the placement tube of the coiling system, different placement speeds, different wire qualities, different wire dimensions and the like lead to a laterally displaced spreading out of the wire with the result that the wire coils are no longer placed centrally on the conveyor system. This may cause the wire coils to be placed with a deviation from the center of 50 to 150 mm. The wire coils are then pushed against the lateral guide surfaces of the conveyor. As a result, the wire surface is damaged and the wire coils are pressed into an oval shape with all negative consequences in the subsequently arranged coil collector. In some rolling mills it has been attempted to counteract this deficiency by providing partially movable guide surfaces on the conveyor system for pushing the placed wire coils back to the center of the conveyor system. However, these measures were also only able to incompletely prevent damage to the wire surface and oval shapes of the wire coils.

SUMMARY OF THE INVENTION

It is, therefore, the primary object of the present invention to provide an arrangement for cooling rolled wire of the above-described type in which the disadvantages in the wire production discussed above are avoided and in which an eccentric displacement of the wire coils on the cooling and conveyor system is prevented, so that the surface of the wire maintains the previously obtained rolled quality.

In accordance with the present invention, in an arrangement for cooling the spread-out wire coils in a controlled manner, a pivotable and/or displaceable coil placement unit is arranged between the coiling unit and the cooling and conveying system.

The feature according to the present invention assures that, in spite of the variety of qualities to be rolled and the variety of wire dimensions and in spite of different speeds, the wire coils are always placed centrally on the conveyor system. Thus, when the personnel operating the arrangement observes from the control stand that a tendency for eccentric placement of the wire coils on the cooling and conveying system exists, the separately arranged coil placement unit is pivoted by a certain extent. The wire coils then follow the pivoted coil placement unit and a central placement of the coils on the conveying system is again ensured.

In accordance with a further development of the invention, the coil placement unit has a joint structure at the transition to the cooling and conveying system, and a rolling or sliding support for the coil placement unit is provided at the transition to the coiling unit and a displacement device acts at least on one of the sides of the coil placement unit located next to the coiling unit. Consequently, it becomes possible to correct the direction of the placed coils already in the region of the coiling unit. Eccentricities of the coils observed in the past which may for different reasons reach up to 150 mm can be prevented by pivoting the coil placement unit to both sides by the appropriate extent.

The pivot point of the coil placement unit is located at the transition area to the cooling and conveying system because it is there where the first coil sets are already solidly placed on the coil placement unit and, thus, a problem-free transition of the coil sets from the coil placement unit to the cooling and conveying system is ensured.

For this reason, an advantageous feature of the invention provides that the width of the coil placement unit corresponds approximately to the width of the cooling and conveying system and the length of the coil placement unit corresponds approximately to the discharge length of the coils from the coiling unit to the first coil sets.

The above-described measures make it possible to completely eliminate the previously used movable lateral guides which mechanically force the wire coils into the center of the conveying system with the attendant damages to the surface of the wire.

In this connection, a particularly advantageous feature of the present invention provides that the cooling and conveying system includes a measuring device directed towards the wire coils, preferably a photo-optical device, for example, a camera, wherein the photo-optical device is in operative connection with the displacement device.

The above measures make it possible to place the wire coils automatically and in a regulated manner on the center of the cooling and conveying system. General operating mistakes which may occur due to inattentive operating personnel and deviations of the wire coils from the center of the conveyor are thoroughly prevented. The control of the coil placement and the correcting measures for example, by appropriate pivoting of the coil placement unit, can now be completely carried out from the operating panel. Thus, the operating personnel can be withdrawn to a significant extent from the dangerous areas of the arrangement.

In order to further influence the optimum placement of the wire coils on the cooling and transporting system, another feature of the present invention provides that the coil placement unit is a roller conveyor. This construction of the coil placement unit is particularly advantageous if the first section of the cooling and conveying system is also a roller conveyor. It is another advantage in this case if the drive of the conveyor rollers of the coil placement unit is a drive unit with controlled rate of rotation, for example, a gear motor. This facilitates different conveying speeds adjusted to the respective wire quality.

In accordance with a further development of the invention, the coil placement unit is part of the cooling and conveying system, wherein the coil placement unit may be provided with its own controllable cooling unit or the coil placement unit may be incorporated structurally and operationally by suitable measures into the cooling unit of the first conveying section. Thus, the cooling and conveying system maintains approximately the same structural length compared to conventional arrangements in spite of the pivotable coil placement unit provided according to the present invention.

For a better adjustment of the coil placement unit to the cooling and conveying system for the spread-out wire coils, the present invention also provides that the coil placement unit is vertically adjustable at least in part, preferably at the transition to the cooling and conveying system. In this case, it is useful if the rollers supporting the coil placement unit are cambered, so that it is ensured that the support of the coil placement unit can roll on the foundation without impairment when the coil placement unit is pivoted.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
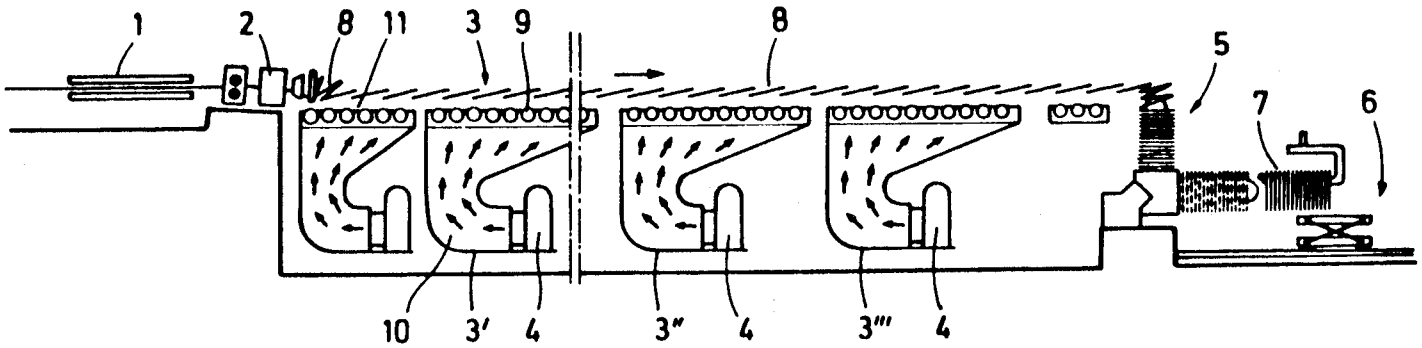
FIG. 1 is a schematic sectional view of an arrangement for cooling rolled wire including a pivotable coil placement unit.

FIG. 1 of the drawing shows an arrangement for cooling rolled steel wire which follows a wire finishing stand series which is not illustrated in the drawing. The cooling arrangement includes a water cooling unit 1, for example, a water ramp, a coiling unit 2, a cooling and conveying system 3 with blowers 4, a coil collector 5 and a hook conveyor 6 for finished wire bundles.

The wire 8 which has been rolled out in the wire finishing roll stand series is quenched in the water ramps 1 from the rolling heat of 900° to 1050° C. to such temperatures which in dependence on the alloy contents are to produce or influence certain properties of the rolled wire. The rolled material is cooled down in stages if no martensite or bainite may be formed at the surfaces. On the other hand, when tempcore wire is produced, a uniform structure from the core to the surface is not desired. Rather, in this case, the rolled wire is cooled in the water ramps to such an extent that martensite is formed at the surface of the wire, wherein the martensite is tempered by the heat existing in the core. The placement temperature of tempcore wire is approximately 500° C., while the other qualities are cooled to a temperature of between 900° C. and 750° C.

The quenched but still red-hot rolled wire is placed in spread-out coils on the cooling and conveying system by means of the coiling unit 2. The cooling and conveying unit 3 which is provided with driven conveyor rollers 9 has three cooling sections 3', 3'', 3'''which are to be differently controlled, wherein each cooling section has a flow housing 10 and a blower 4 underneath the conveyor rollers 9.

The spread-out coils are further conveyed on the cooling conveyor system. On the cooling conveyor system, the coils are cooled by means of blower air very quickly with a cooling rate of 15° to 20° C. per second, wherein the cooling air conveyed by the blowers is conducted from below through the roller conveyor to the coils to be cooled, so that the cooling air flows around the wire coils on all sides thereof.

High cooling rates are required for high-carbon steels and austenite steels which must pass through the transformation zone relatively quickly. On the other hand, a slow cooling rate is required in the case of soft steel or extra-soft steel for obtaining a low and uniform strength. A slow cooling rate is also required for the heat treatment of alloy steels which have a very low transformation temperature.

Accordingly, the optimum cooling and conveying system for the wire coils must be designed so as to be flexible for different cooling variations. Also, it must be observed that in modern rolling mills the wire is rolled out at speeds of 100 m/s in the finished block. Accordingly, it is absolutely necessary that the coils are placed on the cooling and conveying system as accurately and centrally as possible, so that the process requirements are achieved and damage to the surface of the wire due to displacement of the coil arrangement toward the side walls of the conveyor system is avoided. For this purpose, the pivotable coil placement unit 11 is arranged between the coiling unit 2 and the cooling and conveying system 3.

Figure 2:
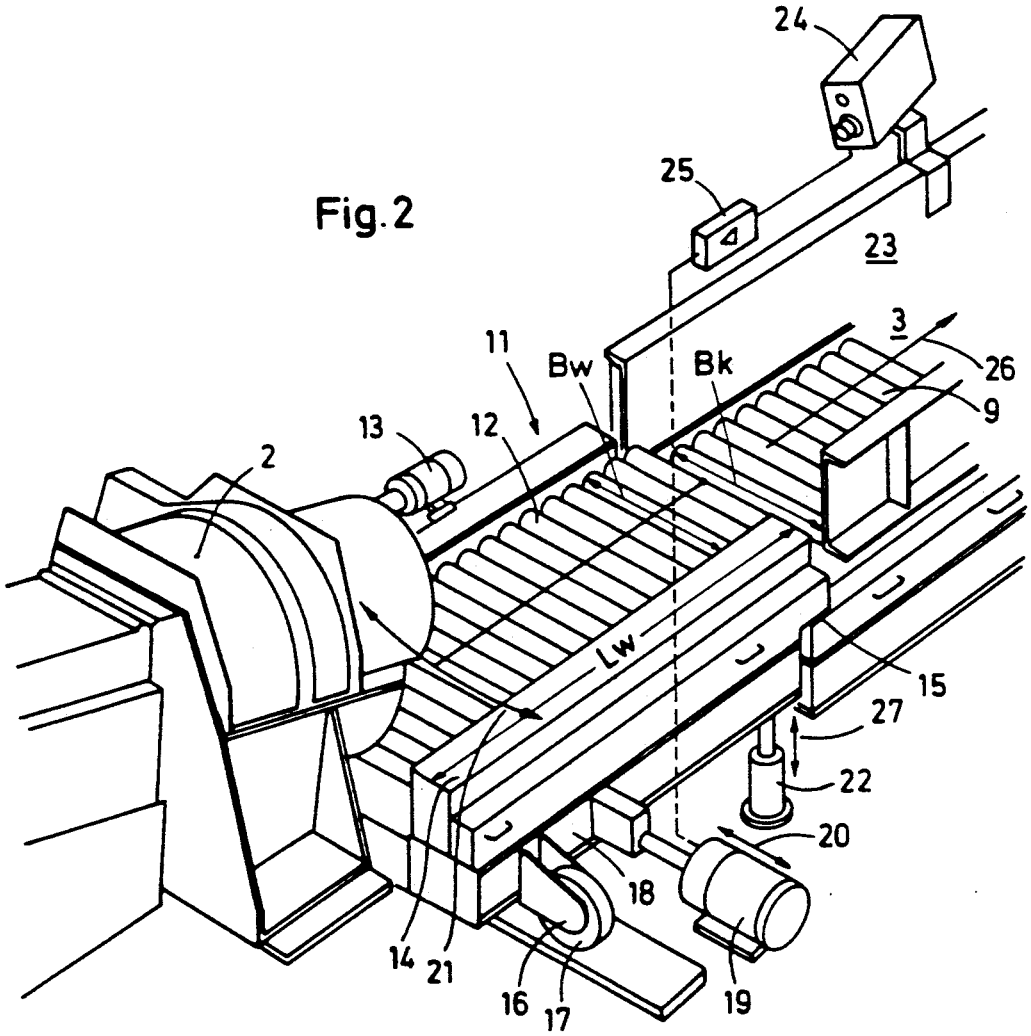
FIG. 2 is a perspective view of the coil placement unit between a coiling unit and cooling and conveying system.

FIG. 2 shows in a perspective view and on a larger scale the coiling unit 2, the pivotable coil placement unit 11 and the first section of the cooling and conveying system 3 which is provided with conveyor rollers 9. The coil placement unit 11 is a roller conveyor whose conveyor rollers 12 are driven by a drive unit 13 whose rate of rotation is controllable. The drive of the individual conveyor rollers is effected in the known manner by means of a chain drive, not shown in detail, which is arranged in a chain box 14.

At the transition to the cooling and conveying system 3, the coil placement unit 11 has a joint construction 15. In addition, at the transition to the coiling unit 2, a rolling support 16 for the coil placement unit is provided. The rollers 17 which support the coil placement units are cambered. A displacement unit 19 acts on the side wall 18 of the coil placement unit 11 which is located next to the coiling unit 2. The displacement unit 19 may be, for example, a piston-cylinder unit. The direction of movement of the displacement unit is indicated by arrow 20. Arrow 21 indicates the pivoting motion of the coil placement unit 12 effected by the displacement unit 19.

A vertically adjustable support column 22 is arranged underneath the coil placement unit 11 at the transition from the coil placement unit 11 to the first section of the conveyor system 3. Also, a camera 24 protected against heat is arranged on the side wall 23 of the first section of the conveyor system 3. The camera 24 is used for continuously observing the pattern of the coils placed by the coiling unit 2. The camera 24 is operationally connected to the displacement unit 19 by means of a measuring transducer and measuring amplifier 25.

When the camera 24 optically registers a displacement of the pattern of the wire coils from the center of the cooling and conveying system 3 and this displacement is displayed on a monitor in the operating stand, the displacement unit 19 is operated by remote control by the operating personnel, so that the coil placement unit 11 is pivoted in the joint construction 15 and is moved on the support rollers 17 in the desired direction of movement 21. As a result of this pivoting of the coil placement unit, the coil pattern, i.e., the coils placed above each other in a spread-out stack, are deflected towards the center of the conveyor system 3 and, thus, the wire can be transported toward the coil collector 5 at the end of the cooling and conveyor system as indicated by arrow 26 without making contact with the side walls 23 of the conveying system 3.

The correction of the coil patterns or the correction of the direction of movement of the wire coils on the cooling and conveying system 3 can be automated by actuating the displacement unit 19 by means of the optical measuring device 24 or through the measuring amplifier and the measuring transducer 25 as soon as a predetermined desired value for a predetermined permissible center deviation is exceeded.

The width Bw of the coil placement unit 11 corresponds essentially to the width Bk of the cooling and conveying system 3 and the length Lw of the coil placement unit 11 corresponds approximately to the placement length of the coils from the coiling unit to the first coil stacks of the spread-out wire 8.

If a vertical adjustment of the conveyor rollers 12 of the coil placement unit 11 to the conveyor rollers 9 of the cooling and transporting system 3 is required, the support column 22 is adjusted as indicated by arrow 27. If the coil placement unit 11 is simultaneously intended to be a cooling unit for the rolled wire and, thus, it is to be included as a cooling section into the cooling and conveying system 3, the coil placement units 11 may be provided with a separate blower housing 10 and an appropriate blower 4, as indicated in FIG. 1. On the other hand, for various reasons, the coil placement unit may also have a thermally insulating hood.

The above-described pivotable coil placement unit arranged between a cooling and conveying system and the coiling unit for the rolled wire meets the above-described object in an excellent manner, i.e., it is capable of placing and conveying the wire coils always centrally on the conveyor rollers.

While a specific embodiment of the invention has been shown and described in detail to illustrate the application of the inventive principle, it will be understood that the invention may be embodied otherwise without departing from such principles.

I claim:

1. An arrangement for cooling in a controlled manner a rolled wire from rolling temperature, the arrangement comprising a cooling unit arranged following a finishing stand, a coiling unit for the wire and a cooling and conveying system for spread-out wire coils, a pivotable and/or displaceable coil placement unit being arranged between the coiling unit and the cooling and conveying system, the coil placement unit having an end adjacent the cooling and conveying system and an end adjacent the coiling unit, the coil placement unit comprising a joint structure at the end at the cooling and conveying system, the coil placement unit further comprising a rolling or sliding support means at the end at the coiling unit, the coil placement unit having a side wall located adjacent the coiling unit, a displacement unit acting at least on the side wall located adjacent the coiling unit, further comprising means for vertically adjusting the end of the coil placement unit at the cooling and conveying system.

2. The arrangement according to claim 1, wherein the coil placement unit includes a thermally insulating hood.

3. The arrangement according to claim 1, wherein the support means includes rollers which are cambered.

4. The arrangement according to claim 1, wherein the roller conveyor includes conveying rollers, and a drive for driving the conveying rollers, the drive being a drive unit with controllable rate of rotation.

5. The arrangement according to claim 1, wherein the coil placement unit and the cooling and conveying system each have a width, the width of the coil placement unit being approximately equal to the width of the cooling and conveying system, and wherein the length of the coil placement unit is approximately equal to a placement length of the coils from the cooling unit to initial stacks of coils being formed.

6. The arrangement according to claim 1, wherein the cooling and conveying system includes a measuring device directed towards the wire coils, the measuring device being in operative connection with the displacement unit.

7. The arrangement according to claim 6, wherein the measuring device is a photo-optical measuring device.

* * * * *